US005146934A

United States Patent [19]

Deevi et al.

[11] Patent Number: 5,146,934

[45] Date of Patent: Sep. 15, 1992

[54] COMPOSITE HEAT SOURCE COMPRISING METAL CARBIDE, METAL NITRIDE AND METAL

[75] Inventors: Seetharama C. Deevi; Sarojini Deevi, both of Midlothian; Mohammad R. Hajaligol, Richmond; Kenneth S. Houghton, Midlothian, all of Va.

[73] Assignee: Philip Morris Incorporated, New York, N.Y.

[21] Appl. No.: 699,490

[22] Filed: May 13, 1991

[51] Int. Cl.[5] ..... A24B 15/16; C10L 5/40; C10L 11/00

[52] U.S. Cl. ..... 131/359; 44/520; 44/522; 44/504

[58] Field of Search ..... 131/359, 352, 364; 44/504, 520, 521, 522, 16 R, 17

[56] References Cited

U.S. PATENT DOCUMENTS

| | | |
|---|---|---|
| 1,771,366 | 7/1930 | Wyss et al. . |
| 2,104,266 | 1/1938 | McCormick . |
| 2,780,537 | 2/1957 | Stelling et al. . |
| 2,907,686 | 10/1959 | Siegel . |
| 3,200,819 | 8/1965 | Gilbert . |
| 3,258,015 | 6/1966 | Ellis et al. . |
| 3,356,094 | 12/1967 | Ellis et al. . |
| 3,572,993 | 3/1971 | Rogers . |
| 3,681,018 | 8/1972 | Knauff . |
| 3,878,041 | 4/1975 | Leitnaker et al. . |
| 3,885,023 | 5/1975 | Gray et al. . |
| 3,943,941 | 3/1976 | Boyd et al. . |
| 4,141,369 | 2/1979 | Burruss . |
| 4,252,687 | 2/1981 | Dale et al. . |
| 4,256,609 | 3/1981 | Dale et al. . |
| 4,303,083 | 12/1981 | Burruss, Jr. . |
| 4,310,334 | 1/1982 | Waldron . |
| 4,317,460 | 3/1982 | Dale et al. . |
| 4,340,072 | 7/1982 | Bolt et al. . |
| 4,477,278 | 10/1984 | Agrawal . |
| 4,515,763 | 5/1985 | Boudart et al. . |
| 4,624,828 | 11/1986 | Alexander . |
| 4,708,151 | 11/1987 | Shelar . |
| 4,714,082 | 12/1987 | Banerjee et al. . |
| 4,780,299 | 10/1988 | Kumagai et al. . |
| 4,784,978 | 11/1988 | Ogasawara et al. . |
| 4,789,534 | 12/1988 | Laine . |
| 4,793,365 | 12/1988 | Sensabaugh, Jr. et al. . |
| 4,799,979 | 1/1989 | Baldi . |
| 4,800,183 | 1/1989 | Quinby . |
| 4,842,759 | 6/1989 | Okamura et al. . |
| 4,851,206 | 7/1989 | Boudart et al. . |

FOREIGN PATENT DOCUMENTS

| | | |
|---|---|---|
| 0117355 | 12/1983 | European Pat. Off. . |
| 0123318 | 4/1984 | European Pat. Off. . |
| 0180162 | 10/1985 | European Pat. Off. . |
| 0236992 | 3/1987 | European Pat. Off. . |
| 0245732 | 5/1987 | European Pat. Off. . |
| WO90/10394 | 3/1989 | World Int. Prop. O. . |

OTHER PUBLICATIONS

J. A. Amiese et al., "Mossbauer Spectroscopic Study of Passivated Small Particles of Iron and Iron Carbide", *The Journal of Physical Chemistry*, 85, pp. 2484–2488 (1981).

M. Audier et al., "Electronic Microscopic and Mossbauer Study of the Iron Carbides —$Fe_3C$ and —$Fe_5C_2$ Formed During the Disproportionation of CO", *Journal of Crystal Growth*, 64, pp. 291–296 (1983).

M. Audier et al., "Transmission Electronic Microscope Study of Single Crystals of $Fe_7C_3$", *Journal of Crystal Growth*, 63, pp. 125–134 (1983).

(List continued on next page.)

*Primary Examiner*—V. Millin
*Attorney, Agent, or Firm*—Marta E. Gross

[57] ABSTRACT

This invention relates to a heat source comprising a mixture of metal carbide, metal nitride and metal which undergo a staged ignition process, particularly useful in smoking articles. The metal carbide/metal nitride/-metal mixtures making up the heat source have ignition temperatures that are substantially lower than conventional carbonaceous heat sources, while at the same time provide sufficient heat to release a flavored aerosol from a flavor bed for inhalation by the smoker. Upon combustion the heat source produces substantially no carbon monoxide or nitrogen oxides.

32 Claims, 3 Drawing Sheets

OTHER PUBLICATIONS

G. H. Barton and B. Gale, "The Structure of a Pseudo--Hexagonal Iron Carbide", *Acta Crystallographica,* 17, pp. 1460-1462 (1964).

H. Bernas et al., "Electronic Exchange and the Mossbauer Effect in Iron-Based Interstitial Compounds", *Journal of Physical Chemistry of Solids,* 28, pp. 17-24 (1967).

J. P. Bouchaud and R. Fruchart, "Contribution a la Connaissance du Diagramme Manganese-Carbone", *Bulletin de la Societe Chimique de France,* pp. 1579-1583 (1964).

"Carbides", *The Encyclopedia Britannica,* 1965, pp. 862-863 and 600-601.

Chapter 6 "Removal of Carbon Monoxide", pp. 97-117, *Catalyst Handbook,* Springer-Verlag New York Inc. Wolfe Scientific Books/London-England (1970).

P. Courty and B. Delmon, "Obtention d'Oxydes Mixtes Divises par Decomposition de Precurseurs Amorphes (sels organiques amorphes)", *C. R. Acad. Sc. Paris, Ser. C,* 268, pp. 1874-1875 (1969).

M. J. Duggin and L. J. E. Hofer, "Nature of —Iron Carbide", *Nature,* 212, pp. 248-250 (1966).

D. J. Dwyer and J. H. Hardenbergh, "The Catalytic Reduction of Carbon Monoxide over Iron Surfaces: A Surface Science Investigation", *Journal of Catalysis,* 87, pp. 66-76 (1984).

R. Fruchart, "Le Role du Facteur Electronique dans les Structures du Type Cementite et les Structures Derivees", *Bulletin de la Societe Chimique de France,* pp. 2652-2657 (1964).

R. R. Gatte and J. Phillips, "The Influence of Particle Size and Structure on the Mossbauer Spectra of Iron Carbides Formed During Fischer-Tropsch Synthesis", *Journal of Catalysis,* 104, pp. 365-374 (1987).

F. H. Herbstein and J. A. Snyman, "Identification of Eckstrom Adcock Iron Carbide as $Fe_7C_3$", *Inorganic Chemistry,* 3, pp. 894-896 (1964).

Imamura et al., "Oxidation of Carbon Monoxide Catalyzed by Manganese-Silver Composite Oxides", *Journal of Catalysts,* 109, pp. 198-205 (1988).

K. H. Jack, *Acta Crystallographica,* 5, pp. 404-411 (1952).

K. H. Jack, *Proceedings of the Royal Society, A,* 195, pp. 34-40 (1948).

K. H. Jack, *Proceedings of the Royal Society, A,* 208, pp. 200-215 (1952).

Kojima et al., "Catalysis by Transition Metal Carbides", *Journal of Catalysts,* 73, pp. 128-135 (1982).

T. Ya. Kosolapova, *Carbides: Properties, Production, and Applications,* pp. 171-177, Plenum Press, New York 1971.

G. Le Caer et al., "Etude par Spectrometrie Mossbauer des Carbures de Fer $Fe_3C$ et $Fe_5C_2$," *Journal of Solid State Chemistry,* 19, pp. 19-28 (1976).

S. C. Lin and J. Phillips, "Study of Relaxation Effects in the $^{57}Fe$ Mossbauer Spectra of Carbon-Supported Iron Carbide Particles", *Journal of Applied Physics,* 58, pp. 1943-1949 (1985).

M. H. Litt and S. M. Aharoni, "Iron Carbides: Preparation from Carbon-Rich Matrix", *Ind. Eng. Chem. Prod. Res. Develop.,* 10, pp. 176-178 (1971).

A. Michel, "Proprietes et Liaisons Dans les Carbures de Fer", *Bulletin de la Societe Chimique de France,* pp. 143-147 (1961).

J. W. Niemantsverdriet et al., "Behavior of Metallic Iron Catalysts during Fischer-Tropsch Synthesis Studied with Mossbauer Spectroscopy, X-ray Diffraction, Carbon Content Determination, and Reaction Kinetic Measurements", *The Journal of Physical Chemistry,* 84, pp. 3363-3371 (1980).

J. W. Reynolds, "Results of Experimental Work to Remove CO from a Mixture of $O_2$ and $N_2$ by Use of Modified Cigarette Filters", Publication from Research Laboratories/Tennessee Eastman Company.

J.-P. Senateur, "Contribution a L'Etude Magnetique et Structurale du Carbure de Hagg", *Annales de Chimie,* 2, pp. 103-122 (1967).

COMPOSITE HEAT SOURCE COMPRISING METAL CARBIDE, METAL NITRIDE AND METAL

BACKGROUND OF THE INVENTION

This invention relates to heat sources comprising mixtures of metal carbide, metal nitride and metal. Upon combustion, the heat sources of this invention undergo a staged ignition process. The component with the lowest ignition temperature ignites first. The combustion of this component provides sufficient heat to ignite a second component, which, in turn, supplies sufficient heat to ignite a third component which supplies the energy necessary to propagate combustion of the heat source. The heat sources of the present invention produce substantially no carbon monoxide or nitrogen oxides. This invention is particularly suitable for use in a smoking article such as that described in commonly assigned U.S. Pat. No. 4,991,606.

There have been previous attempts to provide a heat source for a smoking article. While providing a heat source, these attempts have not produced a heat source having all of the advantages of the present invention.

For example, Siegel U.S. Pat. No. 2,907,686 discloses a charcoal rod coated with a concentrated sugar solution which forms an impervious layer during burning. It was thought that this layer would contain gases formed during smoking and concentrate the heat thus formed.

Ellis et al. U.S. Pat. No. 3,258,015 and Ellis et al. U.S. Pat. No. 3,356,094 disclose a smoking device comprising a nicotine source and a tobacco heat source.

Boyd et al. U.S. Pat. No. 3,943,941 discloses a tobacco substitute which consists of a fuel and at least one volatile substance impregnating the fuel. The fuel consists essentially of combustible, flexible and self-coherent fibers made of a carbonaceous materials containing at least 80% carbon by weight. The carbon is the product of the controlled pyrolysis of a cellulose-based fiber containing only carbon, hydrogen and oxygen.

Bolt et al. U.S. Pat. No. 4,340,072 discloses an annular fuel rod extruded or molded from tobacco, a tobacco substitute, a mixture of tobacco substitute and carbon, other combustible materials such as wood pulp, straw and heat-treated cellulose or a sodium carboxymethylcellulose (SCMC) and carbon mixture.

Shelar et al. U.S. Pat. No. 4,708,151 discloses a pipe with replaceable cartridge having a carbonaceous fuel source. The fuel source comprises at least 60–70% carbon, and most preferably 80% or more carbon, and is made by pyrolysis or carbonization of cellulosic materials such as wood, cotton, rayon, tobacco, coconut, paper and the like.

Banerjee et al. U.S. Pat. No. 4,714,082 discloses a combustible fuel element having a density greater than 0.5 g/cc. The fuel element consists of comminuted or reconstituted tobacco and/or a tobacco substitute, and preferably contains 20%–40% by weight of carbon.

Published European patent application 0 117 355 by Hearn et al. discloses a carbon heat source formed from pyrolized tobacco or other carbonaceous material such as peanut shells, coffee bean shells, paper, cardboard, bamboo, or oak leaves.

Published European patent application 0 236 992 by Farrier et al. discloses a carbon fuel element and process for producing the carbon fuel element. The carbon fuel element contains carbon powder, a binder and other additional ingredients, and consists of between 60% and 70% by weight of carbon.

Published European patent application 0 245 732 by White et al. discloses a dual burn rate carbonaceous fuel element which utilizes a fast burning segment and a slow burning segment containing carbon materials of varying density.

These heat sources are deficient because they provide unsatisfactory heat transfer to the flavor bed, resulting in an unsatisfactory smoking article, i.e., one which fails to simulate the flavor, feel and number of puffs of a conventional cigarette.

Commonly assigned U.S. Pat. No. 5,076,296 solved this problem by providing a carbonaceous heat source formed from charcoal that maximizes heat transfer to the flavor bed, releasing a flavored aerosol from the flavor bed for inhalation by the smoker, while minimizing the amount of carbon monoxide produced.

However, all conventional carbonaceous heat sources liberate some amount of carbon monoxide gas upon ignition. Moreover, the carbon contained in these heat sources has a relatively high ignition temperature, making ignition of conventional carbonaceous heat sources difficult under normal lighting conditions for a conventional cigarette.

Attempts have been made to produce noncombustible heat sources for smoking articles, in which heat is generated electrically, e.g., Burruss, Jr., U.S. Pat. No. 4,303,083, Burruss U.S. Pat. No. 4,141,369, Gilbert U.S. Pat. No. 3,200,819, McCormick U.S. Pat. No. 2,104,266 and Wyss et al. U.S. Pat. No. 1,771,366. These devices are impractical and none has met with any commercial success.

Attempts have been made to produce pyrophoric materials comprising metal aluminides that will burn in a controlled fashion, thereby allowing their use as a decoy for heat-seeking missiles, e.g., Baldi, U.S. Pat. No. 4,799,979. These devices, however, combust too rapidly and produce too intense a heat to be used as a heat source in a smoking article.

Attempts have been made to produce a combustible, non-carbonaceous heat source. Commonly assigned U.S. Pat. No. 5,040,522 is directed to a metal carbide heat source which produces tenfold less carbon monoxide than conventional carbon heat sources. Co-pending U.S. patent application Ser. No. 07/443,636, filed on Nov. 29, 1989 (PM-1389) pending, and commonly assigned herewith, relates to a metal nitride heat source that also produces substantially no carbon monoxide or nitrogen oxides upon combustion. Co-pending U.S. patent application Ser. No. 07/556,732, filed on Jul. 20, 1990 (PM-1347) pending, and commonly assigned herewith, is directed to a heat source comprising carbon and metal carbide that also produces substantially no carbon monoxide or nitrogen oxides upon combustion.

It would be desirable to provide a heat source that has a low temperature of ignition to allow for easy lighting under conditions typical for a conventional cigarette, while at the same time providing sufficient heat to release flavors from a flavor bed.

It would further be desirable to provide a heat source that does not self-extinguish prematurely.

It would also be desirable to provide a heat source that liberates virtually no carbon monoxide or nitrogen oxides upon combustion.

SUMMARY OF THE INVENTION

It is an object of this invention to provide a metal carbide/metal nitride/metal heat source that has an ignition temperature lower than that of conventional carbonaceous heat sources to allow for easy lighting under conditions typical for a conventional cigarette, while at the same time providing sufficient heat to release flavors from a flavor bed.

It is also an object of this invention to provide a metal carbide/metal nitride/metal heat source capable of a staged combustion process which prevents premature self-extinguishment.

It is yet another object of this invention to provide a metal carbide/metal nitride/metal heat source that liberates virtually no carbon monoxide or nitrogen oxides upon combustion.

Metal carbides are hard, brittle materials which are readily reducible to powder form. Metal carbides can have a wide range of stoichimetries.

A preferred example of metal carbide for use in this invention is iron carbide. Iron carbides consist of at least two well-characterized phases —$Fe_5C_2$, also known as Hägg's compound, and $Fe_3C$, referred to as cementite. Other phases of iron carbide may also be formed. J. P. Senateur, *Ann. Chem.*, vol. 2, p. 103 (1967).

Metal nitrides are hard, brittle compounds characterized by high melting points. Metal nitrides are interstitial alloys having atomic nitrogen bound in the interstices of the parent metal lattice. The nitride lattice is closely related to the cubic or hexagonal close-packed lattice found in the pure metal. Metal nitrides can have a wide range of stoichiometries.

Preferred examples of metal nitride for use in this invention are iron nitride and zirconium nitride. Iron nitride, for example, can have formulas ranging from $Fe_2N$ to $Fe_{16}N_2$ (Goldschmidt, H. I., *Interstitial Alloys*, pp. 214–231, Butterworths, London, 1967). Zirconium nitride has the formula ZrN.

Preferred examples of metal for use in this invention is zirconium and iron.

By virtue of its high combustion temperature (greater than 1200° C.), zirconium nitride or zirconium functions as a "hot spot" within the heat source, which generates sufficient thermal energy to sustain the combustion of the heat source as a whole.

The heat sources of this invention comprise mixtures of metal carbide, metal nitride and metal. Upon combustion, the metal carbide/metal nitride/metal mixtures liberate substantially no carbon monoxide or nitrogen oxides. The metal carbide/metal nitride/metal heat sources undergo essentially complete combustion to produce metal oxide, carbon dioxide, and molecular nitrogen, without producing any significant amounts of carbon monoxide or nitrogen oxides.

Catalysts, enhancers and burn additives may be added to the metal carbide/metal nitride/metal mixture to promote complete combustion and to provide other desired burn characteristics.

For use in smoking articles, the heat source should meet a number of requirements in order for the smoking article to perform satisfactorily. It should be small enough to fit inside the smoking article and still burn hot enough to ensure that the gases flowing through are heated sufficiently to release enough flavor from the flavor bed to provide flavor to the smoker. The heat source should also be capable of burning with a limited amount of air until the combusting heat source is expended. Upon combustion, the heat source should produce virtually no carbon monoxide or nitrogen oxides.

The heat source should have an appropriate thermal conductivity. If too much heat is conducted away from the burning zone to other parts of the heat source, combustion at that point will cease when the temperature drops below the extinguishment temperature of the heat source, resulting in a smoking article which is difficult to light and which, after lighting, is subject to premature self-extinguishment. The thermal conductivity should be at a level that allows the heat source upon combustion, to transfer heat to the air flowing through. The heated air flows through a flavor bed, releasing a flavored aerosol for inhalation by the smoker. Premature self-extinguishment of the heat source is prevented by having a heat source that undergoes essentially 100% combustion.

While the heat sources of this invention are particularly useful in smoking articles it is to be understood that they are also useful as heat sources for other applications, where having the characteristics described herein is desired.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

The metal carbide used to make the heat source is preferably iron carbide. Preferably, the iron carbide has the formula $Fe_xC$, where x is between 1 and 3 inclusive. Most preferably, the metal carbide is iron carbide having the formula $Fe_5C_2$. Other metal carbides suitable for use in the heat source of this invention include carbides of titanium, tungsten, manganese and niobium, or mixtures thereof. The metal carbides may contain a small amount of carbon.

The metal nitride used to make the heat source is preferably iron nitride, and more preferably an iron nitride having the formula $Fe_xN$, where x is between 2 and 4 inclusive. An additional preferred metal nitride is zirconium nitride having a formula of ZrN. The most preferable metal nitride is a mixture of iron nitride and zirconium nitride combined in a ratio ranging between about 2:3 and about 3:2 (iron nitride:zirconium nitride). Other metal nitrides suitable for use in this invention include nitrides of aluminum and boron, or mixtures thereof. The metal used to make the heat source is preferably iron and most preferably zirconium.

Figure 1:
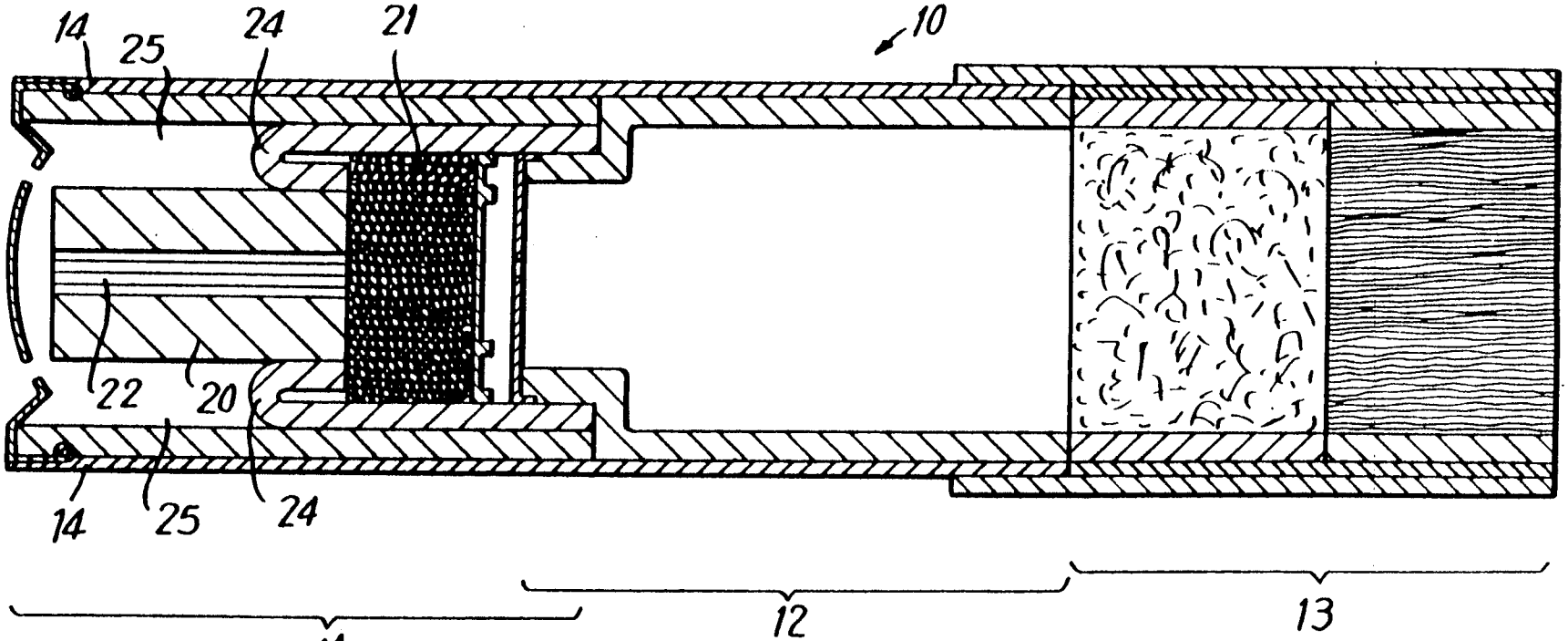
FIG. 1 depicts a longitudinal cross-sectional view of a smoking article in which the heat source of this invention may be used.
Figure 2:
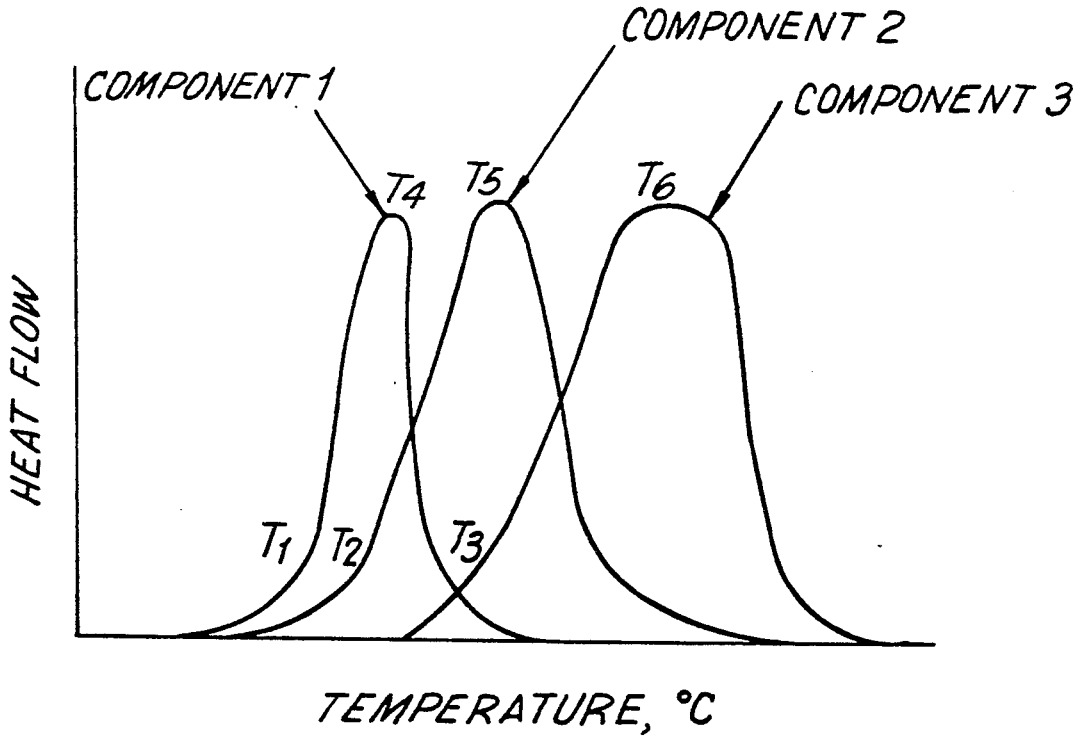
FIG. 2 shows the thermal behavior of the individual components of a heat source with three combustible components.

The components of the metal carbide/metal nitride/metal heat sources of this invention have different ignition temperatures and, therefore, undergo a staged ignition process. As depicted in FIG. 2, upon ignition of the heat source, the component with the lowest ignition temperature ignites first (point $T_1$) This first component generates sufficient heat during its combustion (point $T_4$) to ignite the component with the next highest ignition temperature (point $T_2$). During the combustion of the second component enough heat is generated (point $T_5$) to ignite the component with the next highest ignition temperature (point $T_3$). The third component has a combustion temperature sufficiently high (point $T_6$) to generate the heat necessary to sustain a satisfactory burn of the heat source. This third component has an ignition temperature too high to be reached easily under normal lighting conditions for a conventional cigarette (i.e. match). Therefore this staged ignition process allows for an easy ignition with the benefit of a high temperature combustion.

In a preferred embodiment the heat source comprises three components with different ignition and combustion temperatures. The first component will have an ignition temperature in the range of about 150° C. to about 380° C., preferably, in the range of 180° C. to about 350° C., and most preferably, in the range of about 200° C. to about 300° C. and a combustion temperature in the range of about 350° C. to about 650° C., preferably, in the range of about 400° C. to about 600° C. and most preferably, in the range of about 450° C. to about 550° C.

The second component will have an ignition temperature in the range of about 340° C. to about 600° C., preferably, in the range of about 400° C. to about 600° C., and most preferably, in the range of about 450° C. to about 550° C. and a combustion temperature in the range of about 500° C. to about 800° C., preferably, in the range of about 550° C. to about 750° C., and most preferably, in the range of about 600° C. to about 700° C.

The third component will have an ignition temperature in the range of about 500° C. to about 900° C., preferably, in the range of about 550° C. to about 800° C., and most preferably, in the range of about 600° C. to about 700° C. and a combustion temperature in the range of about 650° C. to about 1500° C., preferably, in the range of about 700° C. to about 1200° C. and, most preferably, in the range of about 750° C. to about 900° C.

The first component preferably will be an iron carbide (prepared by the method of reducing and carbidizing iron oxide at a temperature between about 450° C. and about 900° C., followed by passivating in air, resulting in predominantly $Fe_3C$); an iron nitride (prepared by the nitridation of metallic powders with ammonia); or an iron carbide produced commercially by Daiken Industries, Osaka, Japan.

The second component preferably will be an iron carbide obtained from the commercial source A.D. Mackay Industries, Red Hook, N.Y.

The third component preferably will be an iron nitride from the commercial source A. D. Mackay Industries, Red Hook, N.Y. and, more preferably, a mixture of iron nitride and zirconium nitride or zirconium. The zirconium and zirconium nitride may be obtained from a commercial source Alpha Products Danvers, Mass.

It is believed that these differences in ignition and combustion temperatures between commercially available iron nitride and iron nitride prepared by the above-described method as well as the differences in ignition and combustion temperatures between commercially available iron carbide and iron carbide prepared by the above-described method are due to differences in the methods of making these iron carbides and iron nitrides. These combustion and ignition temperature differences will influence the selection of metal carbides, metal nitrides and metals used in the heat sources of this invention.

Ignition of the above described composite heat source results in a three-stage ignition process. However, a two-stage ignition process is also contemplated by this invention. For example, when iron carbide, made by the above described method, is used as the first component it has a combustion temperature of between about 350° C. and about 650° C. This combustion temperature is high enough to ignite the "third" component (e.g., zirconium nitride, zirconium or commercially available iron nitride) which have ignition temperatures in the range of between about 500° C. and about 900° C. without the need to go through the ignition and combustion of the "second" component. Therefore, it is not a requirement for the staged ignition composite heat sources to have this "second" component. However, the addition of a "second" component with an ignition and combustion temperature which is in between that of the "first" and "third" components will facilitate the ignition of the "third" component.

Ease of lighting of the heat source is accomplished by providing a composite heat source with an ignition temperature of its first igniting component sufficiently low to permit lighting under the conditions desired.

In the case of a smoking article, the lighting conditions desired would be the same as for a conventional cigarette (i.e. a match). The ignition temperature for the heat source 20, which is substantially the same as that of the lowest-igniting component of the heat source, is below about 300° C. and preferably below 225° C. Thus, the preferred mixtures of metal carbides, metal nitrides and metals used in heat source 20 are substantially easier to light than conventional carbonaceous heat sources, which have ignition temperatures in excess of about 380° C.

The heat sources of this invention have combustion characteristics related to the nature and proportion of metal carbides, metal nitrides and metals in the heat source. Any proportion of metal carbide, metal nitride and metal may be used to make the metal carbide/metal nitride/metal mixture as long as the heat source produced possesses the combustion characteristics set forth below.

The combustion temperature for the heat source, i.e., the maximum temperatures achieved during combustion, ranges between about 500° C. to about 1500° C. Combustion, the reaction of the heat source with oxygen to produce heat and light, is flameless and glowing.

The metal components are combined to form a metal carbide/metal nitride/metal mixture preferably in a ratio ranging between about 1:1:1 and about 10:5:1 (metal carbide:metal nitride:metal). Most preferably, the mixture comprises about 1 part iron carbide, about 1 part iron nitride, about 1 part zirconium nitride or about 1 part zirconium.

Mixtures of metal carbides, metal nitrides and metals are highly reactive and may combust spontaneously in air if their reactivity is not passivated. Passivation involves the controlled exposure of the heat source to an oxidant. Preferred oxidants include dilute oxygen or, more preferably, dilute air. While not wishing to be bound by theory, it is believed that a low concentration of oxidant will eliminate pyrophoric sites while preventing the uncontrolled combustion of the heat source.

The rate of combustion of the heat source made from a mixture of metal carbides, metal nitrides and metals can be controlled by manipulating the particle size, surface area and porosity of the heat source materials and by adding certain materials to the heat source.

For example, the heat source may be formed from small particles. Varying the particle size affects the rate of combustion. Smaller particles are more reactive because of the greater surface area available to react with oxygen. This results in a more efficient combustion reaction. The preferred particle size of the metal carbide and metal nitride components may range up to about 700 microns, more preferably between about submicron to about 300 microns. The individual components of the heat source may be synthesized at the desired particle size, or, alternatively, synthesized at a larger size and ground down to the desired size.

The B.E.T. surface area of the composite heat source also has an effect on the reaction rate. Generally, the higher the surface area, the more rapid the combustion reaction. The B.E.T. surface area of both the metal carbide, metal nitride and metal components should be between about 1 $m^2/g$ and about 400 $m^2/g$, preferably between about 10 $m^2/g$ and about 200 $m^2/g$.

The void volume of the heat source is the percentage of a given volume of a heat source unoccupied by the particles of the metal carbides, metal nitrides and metals. Optimizing the void volume maximizes both the amount of the component and the availability of oxygen at the point of combustion. If the void volume becomes too low, then less oxygen is available at the point of combustion. This results in a heat source that is harder to burn. The heat source should have a void volume of about 30% to about 85% of the theoretical maximum density for the metal carbide/metal nitride/metal. However, if a burn additive or enhancer is added to the heat source, it is possible to use a denser heat source, i.e., a heat source having a density approaching 90% of the theoretical maximum. The metal carbide/metal nitride/metal mixture of this invention should have a density of between about 2 g/cc and about 10 g/cc more preferably of between about 3 g/cc and about 7 g/cc and most preferably of between about 3 g/cc and about 5 g/cc and an energy output of between about 1800 cal/g and about 2400 cal/g, more preferably between about 2000 cal/g and about 2300 cal/g and most preferably between about 2100 cal/g and about 2200 cal/g.

Certain enhancers may be used in the heat source to modify the smoldering characteristics of the heat source. Enhancers increase the rate at which the combustion front propagates from one end of the heat source to the other. Enhancers may promote combustion of the heat source at a lower temperature, or with lower concentrations of oxygen, or both. Enhancers include oxidants such as perchlorates, chlorates, nitrates, permanganates, or any substance which burns faster than the fuel elements. Enhancers may be present in the heat source in an amount up to about 0.05% to about 10% by weight of the heat source.

Catalysts may also be added to the heat source to consumme any carbon monoxide formed during combustion. The catalyst is preferably a fine powder of iron oxide coated with gold. The weight percentage of gold to iron oxide is preferably in the range of 0.5% to about 10%. The catalyst may be located in a bed after the heat source. Alternatively, the components of the flavor elements may be contacted with plasticizers, wetting agents and binders followed by particles of the catalyst.

After the metal carbide/metal nitride/metal, burn additives and catalysts have been selected, the mixture is then combined with a binder using any convenient method. The binder confers greater mechanical stability to the metal carbide/metal nitride/metal mixture. Any number of binders can be used. A carbonaceous binder material is preferred. The carbonaceous binder material may be used in combination with other additives, such as potassium citrate, sodium chloride, vermiculite, bentonite or calcium carbonate. Preferable binders include sugar; corn oil; flour and konjac flour derivatives, such as "Nutricol", available from Factory Mutual Corporation; gums such as guar gum; cellulose derivatives, such as methylcellulose and carboxymethylcellulose, hydroxypropyl cellulose; starches; alginates; and polyvinyl alcohols. More preferred binders are inorganic binders, such as The Dow Chemical Company XUS 40303-00 Experimental Ceramic Binder. The metal carbide/metal nitride/metal mixture is preferably combined with the binders so that the mixture has a consistency suitable for extrusion.

The metal carbide/metal nitride/metal mixture may then be pre-formed into a desired shape. Any method capable of pre-forming the mixture into a desired shape may be used. Preferred methods include slip casting, injection molding, and die compaction, and, most preferably, extrusion.

Any desired shape may be used to form the heat source of this invention. Those skilled in the art will understand that a particular application may require a particular shape.

In a preferred embodiment, the mixture is formed into an elongated rod. Preferably, the rod is about 30 cm in length. The diameter of the heat source may range from about 3.0 mm to about 8.0 mm, preferably between about 4.0 mm to about 5.0 mm. A final diameter of approximately 4.0 mm allows an annular air space around the heat source without causing the diameter of the smoking article to be larger than that of a conventional cigarette. The rods before baking are called green rods. Because variations in the dimensions of the rod may occur during baking, it is preferable to form the green rods at a slightly larger diameter than the final diameter of the heat source.

In order to maximize the transfer of heat from the heat source to flavor bed 21, one or more air flow passageways 22, as described in commonly assigned U.S. Pat. No. 5,076,296 may be formed through or along the circumference of heat source 20. The air flow passageways should have a large geometric surface area to improve the heat transfer to the air flowing through the heat source. The shape and number of the passageways should be chosen to maximize the internal geometric surface area of heat source 20. Any configuration that gives rise to a sufficient number of puffs and minimizes the CO produced either under FTC conditions or under more extreme conditions that a smoker may create is within the scope of this invention. Alternatively, the heat source may be formed with a porosity sufficient to allow heat flow through the heat source.

Once the desired shape is formed, it is heated, preferably between about 150° C. to about 600° C. for between about 60 minutes and about 400 minutes. The metal carbide, metal nitride and metal used in the heat source may not be totally stable to heat. Consequently, the formed shapes are preferably heated under an atmosphere which promotes the stability of the metal carbide and metal nitride. More preferably, the atmosphere comprises carbon monoxide (CO), carbon dioxide ($CO_2$) and ammonia ($NH_3$) Most preferably, the atmosphere comprises about 1.4 parts CO, about 2 parts $CO_2$ and about 2 parts $NH_3$.

Baking the formed shapes for too great a duration may have an adverse effect on the components of the heat source. For example, the metal nitride component may decompose if heated at too high a temperature for too long a period of time. The optimum time and temperature may be determined by simple experimentation.

As stated above, variations in the dimensions of the rod may occur during baking. Generally, between about 5% to about 20% change in volume will occur as a result of heating. This change in volume may cause warping or bending. The shape may also suffer inconsistencies in diameter. Following heating, therefore, the shape may be tooled or ground to the dimensions described above.

In a preferred embodiment (the shape being a rod), the rod is cut into shortened segments of between about 8 mm to about 20 mm, preferably between about 10 mm to about 14 mm. The rod produced by this method comprises (1) between about 5% and about 10% carbon; (2) between about 5% and about 60% metal nitride; (3) between about 5% and about 60% metal carbide; and (4) between about 5% and about 30% metal. The rod may additionally contain trace amounts of a high valency metal oxide.

Figure 3:
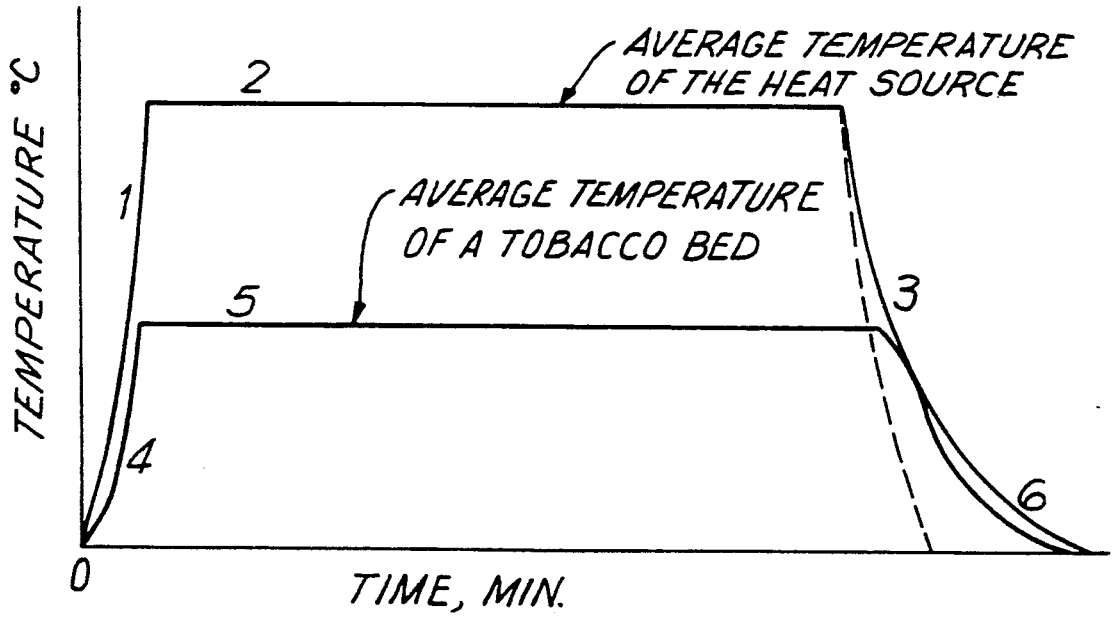
FIG. 3 depicts a plot of time versus temperature upon ignition of a heat source of this invention and transfer of heat to the flavor bed.

When used in a smoking article, the heat source 20 is ignited and then air is drawn through the smoking article, the air is heated as it passes around or through the heat source or through, over or around the air flow passageways. The heated air flows through flavor bed 21, releasing a flavored aerosol for inhalation by the smoker. FIG. 3 depicts the combustion profile of a metal carbide/metal nitride/metal heat source for this embodiment of the invention. Combustion of the heat source results in transfer of heat to the flavor bed. The temperature of the flavor bed rises above ambient temperature but does not reach that of the combusting heat source, thus preventing charring or ashing of the flavor bed.

The following specific examples are intended to illustrate various embodiments of the present invention.

EXAMPLE 1

45 grams of iron carbide from Daiken Industries, Osaka, Japan, 90 grams of iron nitride from A. D. Mackay, Red Hook, N.Y., and 45 grams of zirconium from Alpha Products, Danvers, Mass., were mixed with 270 grams of a composite mixture of carbon/iron oxide in a sigma blade mixer. Mixing was carried out with the addition of 25 grams of methyl cellulose, 25 grams of experimental ceramic binder from The Dow Chemical Company and 5 grams of glycerine. Water was slowly added to the above components to obtain an extrudable paste for use in a lab extruder. Once the desirable consistency was obtained with the paste, 30 cm long rods were extruded using a die which provided a starshaped passageway inside a 4.65 mm diameter green rod. Green rods were placed in the grooves of graphite plates which were stacked together and baked in argon in a step-wise heating to a maximum temperature of 939° F. The baked samples were cut to 14 mm long heat sources. Two heat sources were ignited at one end; one heat source under FTC (35 cc, 2 sec), and the other heat source under 50 cc, 15 sec. intervals. The heat source under FTC lasted for 6 puffs giving 5.5 mg of TPM, 0.21 mg of CO, and 12.20 mg of $CO_2$. The heat source tested under 50 cc, 15 sec. intervals lasted for 11 puffs, giving 24 mg. of TPM, 0.4 mg. of CO, and 24.41 mg. of $CO_2$. The CO values generated are substantially lower than conventional carbonaceous heat sources.

EXAMPLE 2

45 grams of iron carbide from Daiken Industries, Osaka, Japan, 45 grams of iron nitride made in the laboratory by reducing iron oxide and nitriding it with ammonia, and 45 grams of zirconium nitride from Alpha Products, Danvers, Mass., were mixed with 315 grams of a composite mixture of carbon/iron oxide in a sigma blade mixer. The same procedures for producing the baked 14 mm heat source were followed as in Example 1. One 14 mm heat source was placed inside a quartz tube and heated in a flowing argon. The gases were collected and analyzed by a quadrupole mass spectrometer attached to the quartz tube. The CO value obtained was 5.9 $\mu$g/mg of the heat source, which is substantially lower than the CO value obtained from carbonaceous heat sources.

Thus, it is seen that this invention provides a heat source comprising metal carbides, metal nitrides and metals that forms virtually no carbon monoxide or nitrogen oxide gas upon combustion and has a significantly lower ignition temperature than conventional carbonaceous heat sources, while at the same time maximizes heat transfer to the flavor bed. One skilled in the art will appreciate that the present invention can be practiced by other than the described embodiments, which are presented herein for the purpose of illustration and not of limitation, and that the present invention is limited only by the claims which follow.

We claim:

1. A heat source comprising a first component with an ignition temperature in the range of between about 150° C. and about 380° C. and a combustion temperature in the range of between about 350° C. and about 650° C.; a second component with an ignition temperature in the range of between about 340° C. and about 600° C. and a combustion temperature in the range of about 500° C. and about 800° C.; and a third component with an ignition temperature in the range of between about 500° C. and about 900° C. and a combustion temperature in the range of between about 700° C. and about 1500° C.

2. A heat source comprising a first component /with an ignition temperature in the range of between about 150° C. and about 380° C. and a combustion temperature in the range of between about 500° C. and about 650° C.; and a second component with an ignition temperature in the range of between about 500° C. and about 900° C. and a combustion temperature of between about 700° C. and about 1500° C.

3. A heat source for use in a smoking article comprising a first component with an ignition temperature in the range of between about 150° C. and about 380° C. and a combustion temperature in the range of between about 350° C. and about 650° C.; a second component with an ignition temperature in the range of between about 340° C. and about 600° C. and a combustion temperature in the range of about 500° C. and about 800° C.; and a third component with an ignition temperature in the range of between about 500° C. and about 900° C.

and a combustion temperature in the range of between about 700° C. and about 1500° C.

4. The heat source of claim 3, wherein the second component has an ignition temperature in the range of between about 450° C. to about 550° C. and a combustion temperature in the range of between about 600° C. to about 700° C.

5. The heat source of claim 3, wherein the third component has an ignition temperature in the range of between about 600° C. to about 700° C. and a combustion temperature in the range of between about 750° C. to about 900° C.

6. The heat source of claim 3 wherein the second component is selected from the group consisting of a commercial iron carbide and zirconium nitride or a combination of the above.

7. The heat source of claim 3 wherein the third component is selected from the group consisting of a commercial iron nitride, zirconium nitride or a zirconium or a combination of the above.

8. The heat source of claim 3, wherein the first component is iron carbide, the second component is commercial iron carbide and the third component is commercial iron nitride and commercial zirconium nitride.

9. The heat source of claim 8 wherein the ratio by weight of iron carbide to commercial iron carbide to commercial iron nitride to commercial zirconium nitride is 1:1:1:1.

10. A heat source for use in a smoking article comprising a first component with an ignition temperature in the range of between about 150° C. and about 380° C. and a combustion temperature in the range of between about 500° C. and about 650° C.; and a second component with an ignition temperature in the range of between about 500° C. and about 900° C. and a combustion temperature of between about 700° C. and about 1500° C.

11. The heat source of either claims 3 or 10, wherein the first component has an ignition temperature in the range of between about 200° C. to about 300° C. and a combustion temperature in the range of between about 450° C. to about 550° C.

12. The heat source of claim 10 wherein the second component has an ignition temperature in the range of between about 500° C. to about 700° C. and a combustion temperature in the range of between about 750° C. to about 900° C.

13. The heat source of either claims 3 or 10, wherein the first component is selected from the group consisting of iron carbide and iron nitride or a combination of the above.

14. The heat source of claim 10 wherein the second component is selected from the group consisting of a commercial iron nitride, zirconium nitride and zirconium or a combination of the above.

15. The heat source of claim 10, wherein the first component is iron carbide and the second component is iron nitride and commercial zirconium.

16. The heat source of claim 15, wherein the ratio by weight of iron carbide to iron nitride to zirconium is 1:1:1.

17. The heat source of claim 15, wherein the ratio by weight of iron carbide to iron nitride to zirconium is 10:5:1.

18. The heat source of either of claims 3 or 10, wherein the heat source is substantially cylindrical in shape and has one or more fluid passages therethrough.

19. The heat source of claim 18, wherein the fluid passages are formed as grooves around the circumference of the heat source.

20. The heat source of claim 18, wherein the fluid passages are formed in the shape of a multipointed star.

21. The heat source of either of claims 3 or 10, wherein the heat source contains at least one burn additive.

22. The heat source of claim 21, wherein the burn additive is selected from the group consisting of perchlorate, permanganate, chlorate, or nitrate.

23. The heat source of either of claims 3 or 10, wherein the component particles have a size of up to about 700 microns.

24. The heat source of either of claims 3 or 10, wherein the component particles have a size in the range of about submicron to about 300 microns.

25. The heat source of either of claims 3 or 10, wherein the component particles have a B.E.T. surface area in the range of about 1 $m^2/g$ to about 400 $m^2/g$.

26. The heat source of either of claims 3 or 10, wherein the component particles have a B.E.T. surface area in the range of about 10 $m^2/g$ to about 200 $m^2/g$.

27. The heat source of either of claims 3 or 10, wherein the heat source has a void volume of about to about 85%.

28. The heat source of either of claims 3 or 10, wherein the heat source has a pore size of about submicron to about 100 microns.

29. The heat source of either of claims 3 or 10, wherein the heat source has a density of about 2.0 g/cc to about 10.0 g/cc.

30. The heat source of either claims 3 or 10, wherein the heat source contains at least one catalyst.

31. The heat source of claim 30, wherein the catalyst is iron oxide coated with gold.

32. The heat source of claim 30, wherein the catalyst comprises 0.5% to 10% gold/$Fe_2O_3$ by weight.

* * * * *